US009551364B2

(12) United States Patent
Maurer et al.

(10) Patent No.: US 9,551,364 B2
(45) Date of Patent: Jan. 24, 2017

(54) HYDRAULIC CYLINDER WITH DRIFT STOP

(71) Applicant: PARKER-HANNIFIN CORPORATION, Cleveland, OH (US)

(72) Inventors: Garrett Maurer, Minnetonka, MN (US); Romell Alaman, Eden Prairie, MN (US)

(73) Assignee: Parker-Hannifin Corporation, Cleveland, OH (US)

( * ) Notice: Subject to any disclaimer, the term of this patent is extended or adjusted under 35 U.S.C. 154(b) by 395 days.

(21) Appl. No.: 14/047,049

(22) Filed: Oct. 7, 2013

(65) Prior Publication Data

US 2014/0102291 A1 Apr. 17, 2014

Related U.S. Application Data

(60) Provisional application No. 61/713,682, filed on Oct. 15, 2012.

(51) Int. Cl.
*F15B 15/02* (2006.01)
*F15B 15/26* (2006.01)

(52) U.S. Cl.
CPC ..... *F15B 15/02* (2013.01); *F15B 15/261* (2013.01)

(58) Field of Classification Search
CPC ..... F15B 15/261; F15B 2015/268
USPC ..... 92/15, 24, 26
See application file for complete search history.

(56) References Cited

U.S. PATENT DOCUMENTS 3,397,620 A * 8/1968 Skelton ..... F15B 15/261 92/24
3,498,182 A * 3/1970 Selke ..... F15B 15/261 91/44
4,524,676 A * 6/1985 Rogers ..... F15B 15/261 92/24
4,635,536 A * 1/1987 Liu ..... F15B 15/261 92/24
5,097,748 A * 3/1992 Koch ..... F15B 15/261 92/24
5,193,431 A * 3/1993 Propsting ..... E05F 15/56 92/21 R
7,451,688 B2 * 11/2008 Takahashi ..... F15B 15/261 92/20
7,784,392 B1 * 8/2010 Manney, III ..... F15B 15/204 92/181 R

* cited by examiner

*Primary Examiner* — Thomas E Lazo
(74) *Attorney, Agent, or Firm* — Robert J. Clark

(57) ABSTRACT

A hydraulic fluid power cylinder assembly 10 includes a cylinder chamber 14, a piston 15, a piston rod 19 and an end cap 21. End cap 21 includes a drift stop chamber 24 and a drift stop blocking surface 25. Chamber 24 is in open fluid pressure communication with chamber 14 under all conditions. Piston 15 includes a piston body portion 16 and a drift stop body portion 29. Drift stop body portion 29 includes a drift stop blocking member 31 and a positioning surface 34 for preventing the blocking member 31 from contacting the walls of cavity 24 and cylinder chamber 14 when disengaged from blocking surface 25. In one position drift stop body portion 29 is received within drift stop cavity 24, and blocking member 31 engages blocking surface 25 to prevent unintended movement of piston 15.

14 Claims, 3 Drawing Sheets

HYDRAULIC CYLINDER WITH DRIFT STOP

CROSS REFERENCE TO RELATED APPLICATIONS

The present application claims the benefit of the filing date of U.S. Provisional Patent Application Ser. No. 61/713,682 filed Oct. 15, 2012, the disclosure of which is incorporated herein by reference in its entirety.

TECHNICAL FIELD

This invention relates to a fluid power cylinder assembly. More specifically, this invention relates to a hydraulic fluid power cylinder assembly having a piston and a drift stop to prevent unintended movement of the piston.

BACKGROUND AND SUMMARY OF THE INVENTION

Fluid power cylinder assemblies including, for example, hydraulic cylinder assemblies, are widely used to impart controlled motion to objects in many applications including, for example, construction, agricultural, industrial, aerospace, marine, and land vehicle applications. In some of these assemblies or applications, technical problems may include unintended drift or movement of the piston of the hydraulic cylinder assembly. Such drift may be caused by, for example, forces acting on the piston including weight of the piston and objects connected to it, seal or system leakage, cylinder housing internal surface damage, vibrations, or contamination. Additional technical problems may include alignment, assembly, complexity, cost, and reliability.

Various hydraulic locks may be used to lock and unlock hydraulic cylinders. One prior art fluid power cylinder assembly with a hydraulic lock is shown in U.S. Pat. No. 4,524,676, in which controlled hydraulic pressure in a bore 17 causes a plunger 17 to lift to permit extension or retraction of the piston of the assembly. Another fluid power cylinder assembly with a lock is shown in U.S. Pat. No. 5,097,748, in which a locking piston 11 holds balls 25 in a locked position to lock a piston 3 and releases the balls 25 in an unlocked position to allow the balls 25 to move out of groove 26 while executing a stroke. Another fluid power cylinder assembly with a lock is shown in U.S. Pat. No. 7,784,392, in which a bidirectional control relief valve 10 includes a poppet valve 30 that closes under certain conditions to seal off fluid volume 60 to lock a piston 12. Further, European Patent Application EP 1,197,668 A1 discloses a hydraulic lock device in which high pressure fluid from a pressure booster 7 acts on the outside of a thin wall sleeve 5 and deforms the sleeve 5 inwardly to lock a rod 3.

The present invention departs from these prior art hydraulic fluid power cylinder assemblies and addresses the above described and other technical problems and provides a fluid power cylinder assembly that is relatively easy to assemble and align and that has low complexity and low cost and high reliability.

At least one embodiment of the invention may provide a fluid power cylinder assembly that includes a cylinder body and a piston. The cylinder body may have a generally cylindrical interior surface defining a longitudinally extending cylinder chamber. The piston may have a generally cylindrical longitudinally extending piston body portion with a generally cylindrical exterior surface slidably disposed within the cylinder interior surface.

At least one embodiment of the invention may provide a drift stop body portion that may be fixed to the piston body portion and spaced laterally inwardly from the interior surface of the cylinder body. A longitudinally extending drift stop cavity may be defined by a longitudinally extending drift stop cavity wall, and the drift stop cavity may have an open end opening into the cylinder chamber. The drift stop cavity may be in open fluid pressure communication with the cylinder chamber under all conditions. The drift stop body portion may extend longitudinally into the drift stop cavity when the piston body portion and the drift stop body portion are each in one position. The drift stop body portion may be longitudinally spaced from the drift stop cavity when the piston body portion and the drift stop body portion are each in another position.

At least one embodiment of the invention may provide a drift stop blocking surface that may be carried by one of the drift stop cavity wall and drift stop body portion, and a laterally movable drift stop blocking member carried by the other of the drift stop cavity wall and the drift stop body portion. The drift stop blocking member may have one position engaging the drift stop blocking surface to limit longitudinal movement of the piston when the piston body portion and the drift stop body portion are each in their one position. The drift stop blocking member may have another position spaced from the drift stop blocking surface when the piston body portion and the drift stop body portion are each in their other position.

At least one embodiment of the invention may provide a drift stop blocking surface that may be carried by the drift stop cavity wall, and the drift stop blocking member may be carried by the drift stop body portion. The drift stop blocking member may be laterally aligned with and laterally spaced from the drift stop cavity wall when the drift stop body is received in the drift stop cavity. The drift stop body portion may extend longitudinally from the piston body portion. The combined lateral cross sectional area of the drift stop body portion within the drift stop cavity and piston body portion within the cylinder chamber may be substantially equal to the lateral cross sectional area of the cylinder chamber, and the combined lateral cross sectional area may be exposed to fluid pressure of the drift stop cavity and cylinder chamber under all conditions. The drift stop blocking member may be pressure balanced under all conditions. The force of fluid pressure acting on the combined lateral cross sectional area may provide the sole means for disengaging the drift stop blocking member from the drift stop blocking surface.

At least one embodiment of the invention may provide a laterally extending drift stop blocking member passage in the drift stop body portion, and the drift stop blocking member may be slidably disposed in the passage. An end cap may be fixed against movement relative to the cylinder body, and the drift stop cavity may be disposed in the end cap. A drift stop blocking member positioning surface may be provided, and the drift stop blocking member may engage the positioning surface to retain the drift stop blocking member away from the drift stop cavity wall and away from the cylinder interior surface when the drift stop blocking member and the drift stop surface are disengaged from one another. A drift stop blocking member spring may be carried by the drift stop body member, and the drift stop spring may bias the drift stop blocking member laterally outwardly against the positioning surface when the drift stop blocking member is disengaged from the drift stop blocking surface. The positioning surface may be a reduced diameter region of the passage.

At least one embodiment of the invention may provide the drift stop blocking surface including an annular ridge extending laterally inwardly from the drift stop cavity wall and at least one substantially conical surface. The drift stop blocking member may be generally spherical. The drift stop body portion may extend longitudinally from the piston body portion, and the piston body portion and the drift stop body portion may be of integral single piece construction. The piston body portion and the drift stop body portion may be concentrically disposed along a longitudinal axis.

This Summary is not intended to identify all key features or essential features of the claimed subject matter, and these and other features of the invention are more fully described and particularly pointed out in the description and claims set out below. The following description and claims and the annexed drawings set forth in detail certain illustrative embodiments of the invention, and these embodiments indicate but a few of the various ways in which the principles of the invention may be used.

BRIEF DESCRIPTION OF THE DRAWINGS

Embodiments of this invention will now be described in further detail with reference to the accompanying drawings, in which.

DETAILED DESCRIPTION OF THE DRAWINGS

Figure 1:
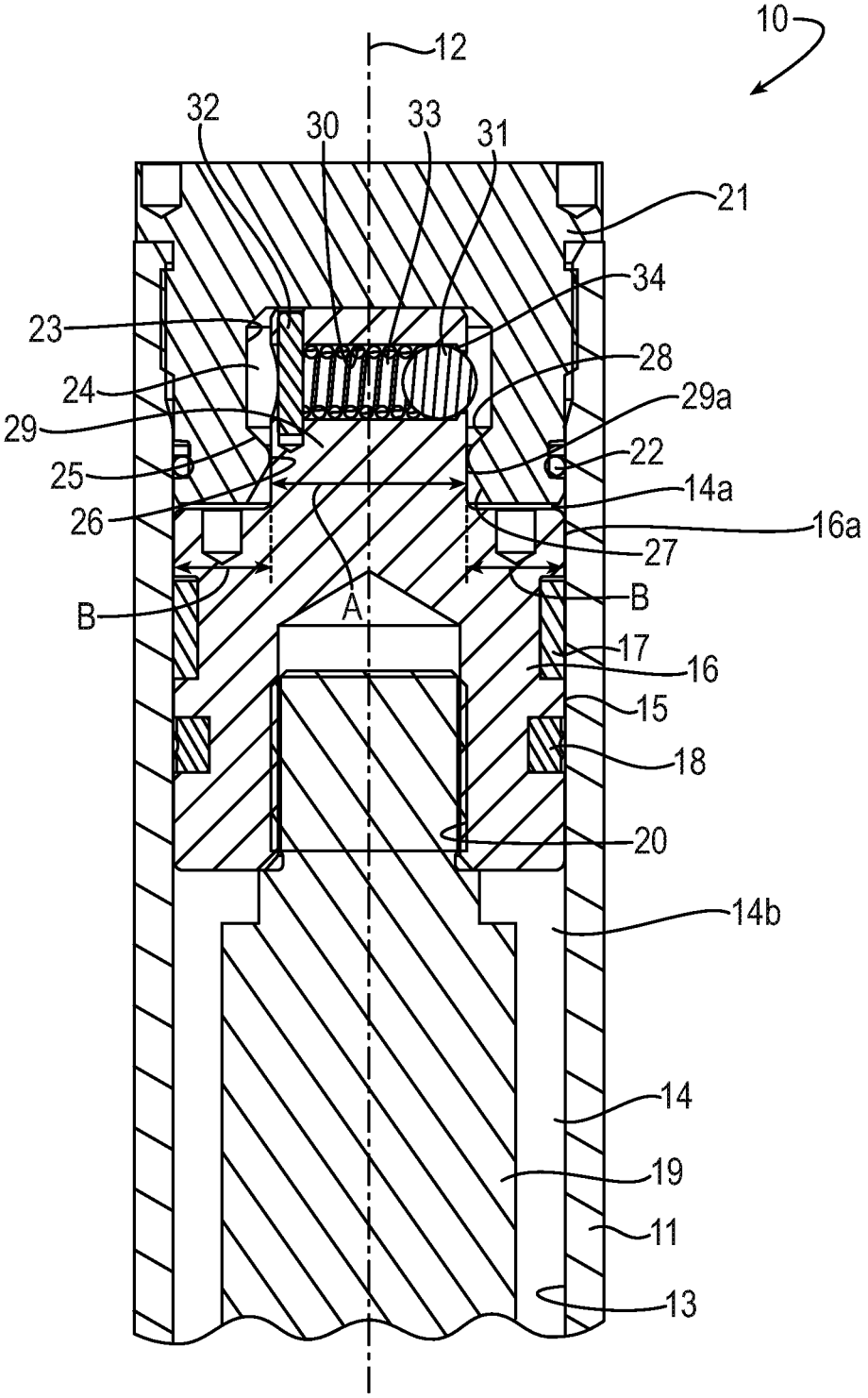
FIG. 1 is a cross sectional view of a fluid power cylinder assembly according to a preferred embodiment of the invention, showing the assembly in a first position.

Referring now to the drawings in greater detail, FIG. 1 illustrates a preferred embodiment of a fluid power cylinder assembly 10 according to the present invention. The assembly 10 is preferably operated by hydraulic fluid under pressure as described below, and other types of fluids including, for example, air or water based fluids, may alternatively be used.

The assembly 10 includes a generally cylindrical longitudinally extending cylinder body 11 having a longitudinal axis 12. Structural and/or mounting hardware (not shown) may be provided on the exterior of the cylinder body 11 for reinforcing and/or mounting the assembly 10 as required. The cylinder body 11 includes a generally cylindrical interior surface or cylinder bore 13 that defines a longitudinally extending cylinder chamber 14. A generally cylindrical longitudinally extending piston 15 having a piston body portion 16 with a generally cylindrical exterior surface 16*a* is slidably disposed within chamber 14 and is sealed against the cylinder bore 13 by suitable annular seals 17 and 18 to prevent fluid leakage. The seals 17 and 18 are selected according to the fluids and pressures and temperatures and other operating conditions for the assembly 10, and in the preferred embodiment the seals 17 and 18 may include polyurethane piston seals. The piston 15 divides the cylinder chamber 14 into a first chamber 14*a* on the top side of piston 15 as viewed in FIG. 1 and a second chamber 14*b* on the bottom side of piston 15. A generally cylindrical piston rod 19 is threadably secured into a threaded blind bore 20 on one side of the piston 15 and moves with the piston 15 under all conditions.

An end cap 21 is threadably secured to one end of the cylinder body 11, and suitable seals 22 such as, for example, a synthetic rubber O-ring with a backup ring, prevent fluid leakage between the end cap 21 and the cylinder bore 13. The end cap 20 includes a longitudinally extending drift stop cavity wall 23 which defines a longitudinally extending drift stop cavity 24. The wall 23 and cavity 24 may be of any desired lateral cross sectional geometric shape and are generally cylindrical in the preferred embodiment. The drift stop cavity 24 has an open end that opens into the cylinder chamber 14*a* intermediate the end cap 21 and the piston 15 with open fluid pressure communication under all conditions in the illustrated preferred embodiment. In an alternate embodiment not shown in the drawings, the drift stop cavity 24 may be arranged in a sleeve or other structure in the cylinder chamber 14*b* on the rod side of the piston 15. A drift stop cavity blocking surface 25 is disposed in the drift stop cavity 24 and is carried by the drift stop cavity wall 23. In the preferred embodiment, the blocking surface 25 is substantially adjacent the open end of the drift stop cavity 24 and is an annular ridge extending laterally inwardly from cavity wall 23 and having a ridge crest 26 defined by oppositely facing substantially conical ramp surfaces 27 and 28.

A drift stop body portion 29 having an exterior surface 29*a* is fixed to the piston body portion 16 of piston 15 for movement with the piston body portion 16 and is laterally inwardly spaced from the cylinder bore 13. The drift stop body portion 29 and its exterior surface 29*a* may be of any desired lateral cross sectional geometric shape and are generally cylindrical in the preferred embodiment. The drift stop body portion 29 extends longitudinally from the piston body portion 16, and in the preferred embodiment the piston body portion 16 and the drift stop body portion 29 are of integral single piece construction. Alternatively, the drift stop body portion 29 may be disposed on the other side of piston 15 when the drift stop cavity is located on the other side of the piston 15, and in this alternate embodiment the drift stop body portion 29 be formed integrally with the piston rod 19. The cylinder body 11, piston 15 (including the piston body portion 16 and the drift stop body portion 29), rod 19 and end cap 21 are concentrically disposed along the longitudinal axis 12 and may be of any suitable material. In the preferred embodiment, these components are all of aluminum.

A drift stop passage 30 extends laterally from side to side through the drift stop body portion 29. A drift stop blocking member 31 is carried by drift stop body portion 29 and is slidably disposed in passage 30. In the preferred embodiment the blocking member 31 is a generally spherical steel ball. A pin or spring stop 32 is frictionally secured in a longitudinal hole that intersects the lateral passage 30, and a spring 33 is disposed in passage 30 intermediate blocking member 31 and pin 32. The end of passage 30 opposite pin 32 is of reduced diameter and provides a positioning surface 34 for blocking member 31 as explained further below. The described arrangement of the drift stop cavity 24 and drift stop body 29 with blocking member 31 permits easy alignment of these components during assembly and operation without requiring precise tolerances or seals for these components.

Referring still to FIG. 1, fluid power cylinder assembly 10 is illustrated in one position which is also referred to as a first or retracted position. In this position, drift stop body portion 29 extends longitudinally into drift stop cavity 23. Blocking member 31 is laterally aligned with drift stop cavity wall 23, and spring 33 biases blocking member 31 laterally outwardly against positioning surface 33 to retain blocking member 31 laterally spaced away from cavity wall 23, with blocking member 31 either spaced longitudinally from or initially longitudinally engaged against blocking surface 25. If a force urges piston 15 to move in a downward direction, drift stop blocking member 31 engages conical surface 28 of drift stop blocking surface 25 to create a blocking force to retain drift stop body portion 29 within drift stop cavity 24 and prevent such downward movement. The preload of spring 33 and the ramp angle of conical surface 28 relative to longitudinal axis 12 are selected to determine the amount of this force that will be blocked by drift stop blocking member 31 and blocking surface 25, to prevent unintentional movement of drift stop body portion 24 out of drift stop cavity 24 and unintentional movement of piston 15 relative to cylinder body 11 from this first position.

Figure 2:
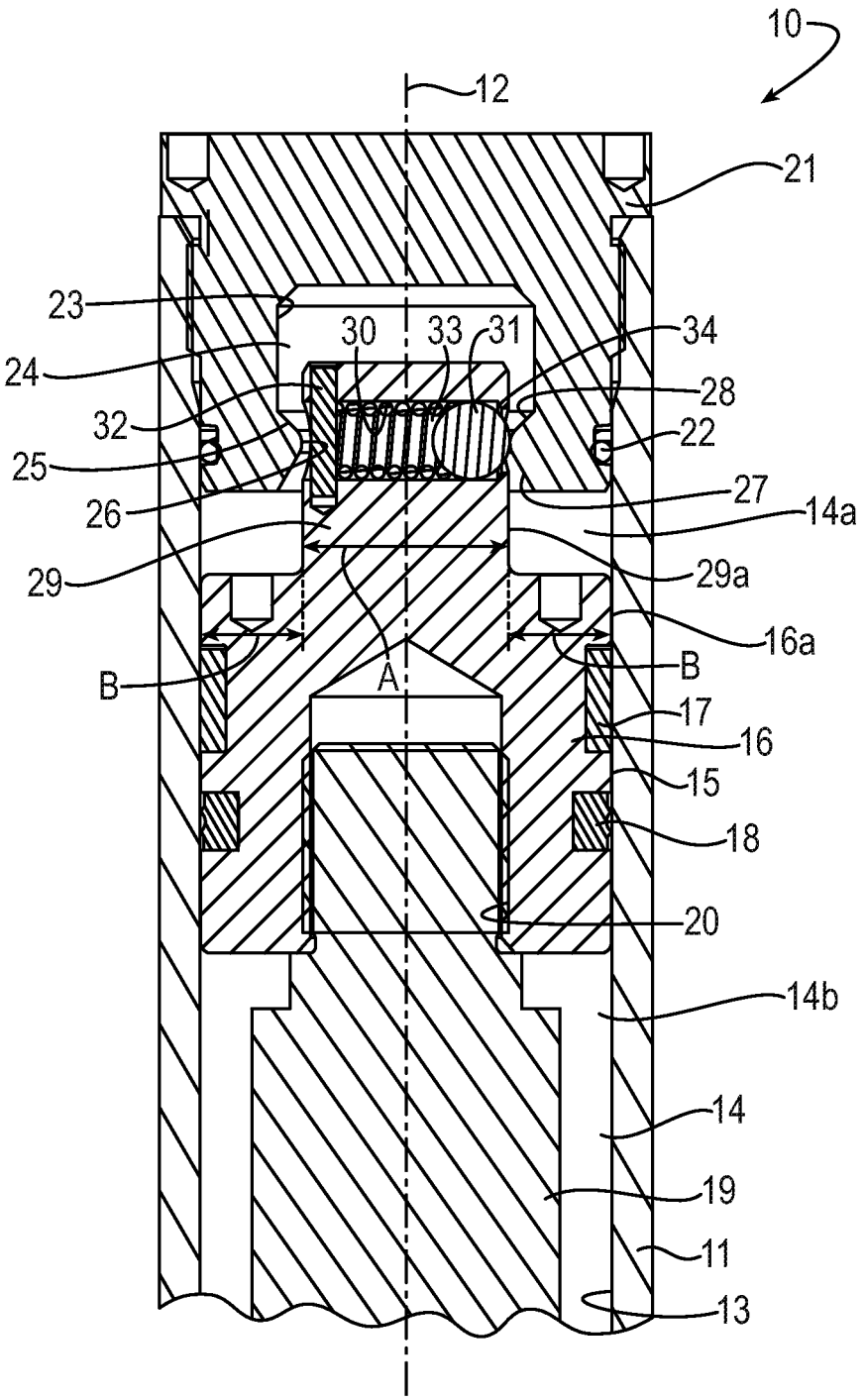
FIG. 2 is a cross sectional view similar to FIG. 1, showing the assembly in a second position.

If intentional movement of piston 15 relative to cylinder body 11 is desired, hydraulic fluid pressure is introduced into the cylinder chamber 14*a* between piston 15 and end cap 21 by a suitable hydraulic control system (not shown). Because drift stop cavity 24 is in open fluid pressure communication with cylinder chamber 14*a* under all conditions, this hydraulic fluid pressure acts on the total or combined lateral cross sectional area of A (which is the lateral cross sectional area of the drift stop body portion 29 within cavity 24) and B (which is the annular lateral cross sectional area of piston body portion 16 within cavity 14), which is substantially equal to the total lateral cross sectional area of the interior surface 13 of cylinder body 11. Because the fluid pressure of the drift stop cavity 24 and cylinder chamber 14*a* acts on this combined area, the blocking force described above created by engagement of blocking member 31 with blocking surface 25 can be relatively large while still permitting relatively low fluid pressure to move piston 15 and disengage blocking member 31 from blocking surface 25. As this fluid pressure increases and piston 15 begins to move downwardly as viewed in FIG. 1, drift stop body portion 29 begins to move out of drift stop cavity 24. Blocking member 31 engages blocking surface 25 and begins to move laterally inwardly against the bias of spring 33 in a direction away from cavity wall 23 along conical ramp 28. Blocking member 31 is pressure balanced by having equal fluid pressures on all sides, so that the force created by fluid pressure acting on the areas A and B creates the sole means for disengaging the blocking member 31 from the blocking surface 25. Continued downward movement of piston 15 causes continued longitudinal movement of drift stop body portion 29 in a direction out of drift stop cavity 24, and causes continued lateral movement of blocking member 31 along conical ramp 28 until crest 26 is reached in a second position of cylinder assembly 10 illustrated in FIG. 2. In this second position, blocking member 31 is laterally aligned with crest 26 of blocking surface 25 and drift stop body portion 16 is still at least partially received within drift stop cavity 24. Blocking member 31 is spaced laterally inwardly away from positioning surface 34. Once this second position is reached and piston 15 continues to move downwardly as viewed in FIG. 2, drift stop blocking member 31 no longer acts to prevent drift of piston 15 relative to cylinder body 11. Continued application of fluid pressure and flow into cylinder chamber 14*a* between piston 15 and end cap 21 causes cylinder assembly 10 to move toward another or third position as viewed in FIG. 3. In this third position, drift stop blocking member 31 is laterally aligned with interior surface 13 of cylinder body 11 and drift stop body portion 16 is fully removed from drift stop cavity 24. The drift stop blocking member 31 in this position engages the positioning surface 34 to retain the drift stop blocking member 31 away from the interior surface 13.

Figure 3:
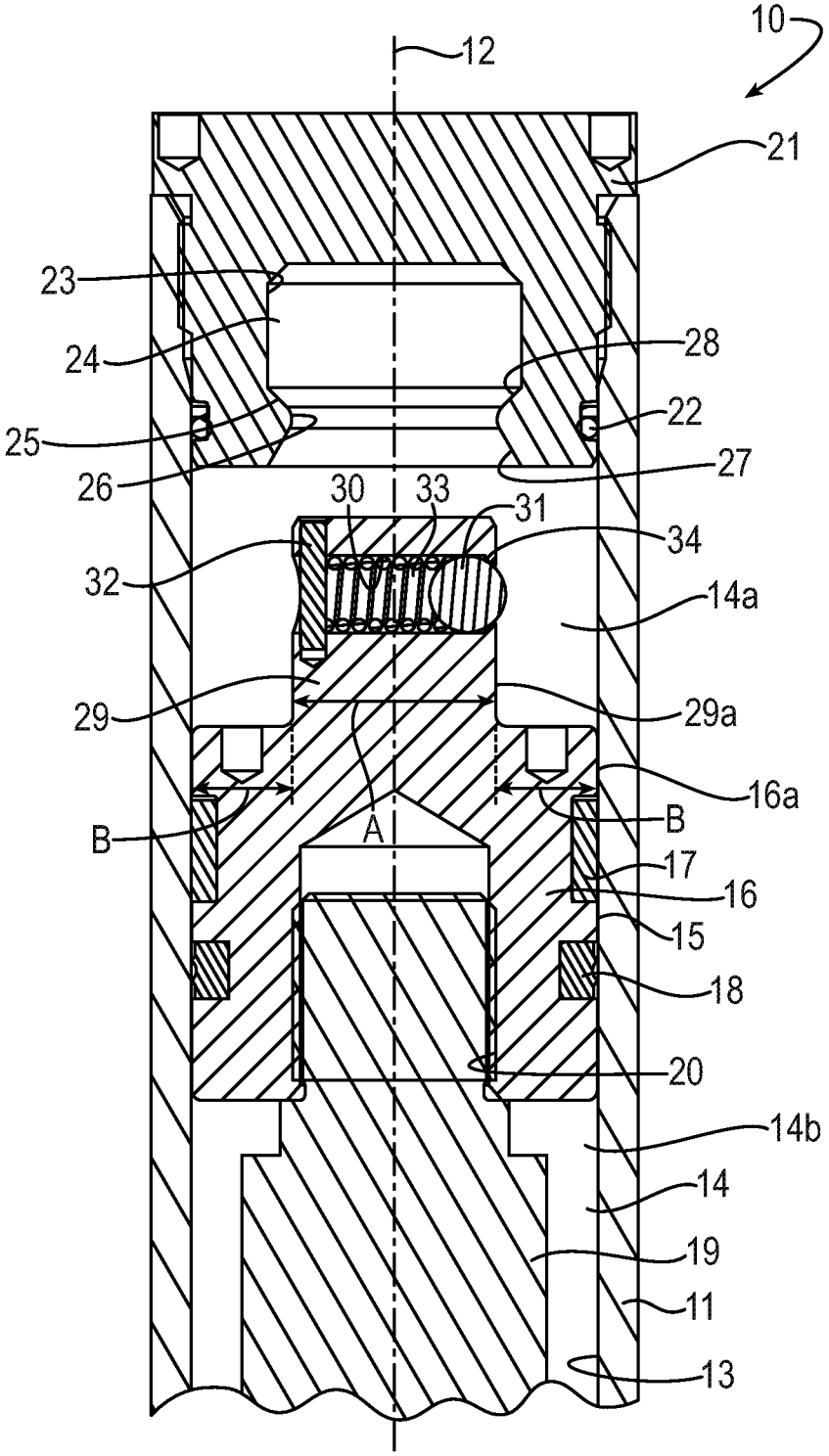
FIG. 3 is a cross sectional view similar to FIG. 1, showing the assembly in a third position.

When fluid power cylinder assembly 10 is to be retracted from the third position illustrated in FIG. 3, fluid pressure and flow may be applied to the cylinder chamber 14*b* to move the piston 15 upwardly as viewed in FIG. 3 if assembly 10 is a double acting cylinder. Blocking member 31 will engage conical surface 27 of blocking surface 25, and blocking member 31 will ride along conical surface 27 until crest 26 is reached in the second position illustrated in FIG. 2. Continued application of fluid pressure and flow into chamber 14*b* causes fluid power assembly 10 to return to its first position illustrated in FIG. 1, in which blocking member 31 and blocking surface 25 restrain piston 15 against unintentional drifting movement.

Presently preferred embodiments of the invention are shown and described in detail above. The invention is not, however, limited to these specific embodiments. Various changes and modifications can be made to this invention without departing from its teachings, and the scope of this invention is defined by the claims set out below.

The invention claimed is:

1. A fluid power cylinder assembly comprising a cylinder body and a piston, the cylinder body having a generally cylindrical interior surface defining a longitudinally extending cylinder chamber, the piston having a generally cylindrical longitudinally extending piston body portion with a generally cylindrical exterior surface slidably disposed within the cylinder interior surface, a drift stop body portion fixed to the piston body portion and spaced laterally inwardly from the interior surface of the cylinder body, a longitudinally extending drift stop cavity defined by a longitudinally extending drift stop cavity wall, the drift stop cavity having an open end opening into the cylinder chamber, the drift stop cavity being in open fluid pressure communication with the cylinder chamber under all conditions, the drift stop body portion extending longitudinally into the drift stop cavity when the piston body portion and the drift stop body portion are each in one position, the drift stop body portion being longitudinally spaced from the drift stop cavity when the piston body portion and the drift stop body portion are each in another position, a drift stop blocking surface carried by the drift stop cavity wall, a laterally movable drift stop blocking member carried by the drift stop body portion, the drift stop blocking member having one position engaging the drift stop blocking surface to limit longitudinal movement of the piston when the piston body portion and the drift stop body portion are each in their one position, and the drift stop blocking member having another position spaced from the drift stop blocking surface when the piston body portion and the drift stop body portion are each in their other position, wherein the drift stop body portion extends longitudinally from the piston body portion, a combined lateral cross sectional area of the drift stop body portion within the drift stop cavity and piston body portion within the cylinder chamber is substantially equal to a lateral cross sectional area of the cylinder chamber, and the combined lateral cross sectional area is exposed to fluid pressure of the drift stop cavity and cylinder chamber under all conditions, and wherein the force of fluid pressure acting on the combined lateral cross sectional area provides the sole means for disengaging the drift stop blocking member from the drift stop blocking surface.

2. A fluid power cylinder assembly as set forth in claim 1, wherein the drift stop blocking member is laterally aligned with and laterally spaced from the drift stop cavity wall when the drift stop body is received in the drift stop cavity.

3. A fluid power cylinder assembly as set forth in claim 1, wherein the drift stop blocking member is pressure balanced under all conditions.

4. A fluid power cylinder assembly as set forth in claim 1, including a laterally extending drift stop blocking member passage in the drift stop body portion, and the drift stop blocking member is slidably disposed in the passage.

5. A fluid power cylinder assembly as set forth in claim 1, including an end cap fixed against movement relative to the cylinder body, and the drift stop cavity is disposed in the end cap.

6. A fluid power cylinder assembly as set forth in claim 1, including a drift stop blocking member positioning surface, the drift stop blocking member engages the positioning surface to retain the drift stop blocking member away from the drift stop cavity wall and away from the cylinder interior surface when the drift stop blocking member and the drift stop surface are disengaged from one another.

7. A fluid power cylinder assembly as set forth in claim 6, including a drift stop blocking member spring carried by the drift stop body member, the drift stop spring biases the drift stop blocking member laterally outwardly against the positioning surface when the drift stop blocking member is disengaged from the drift stop blocking surface.

8. A fluid power cylinder assembly as set forth in claim 1, including a laterally extending drift stop blocking member passage extending laterally from side to side through the drift stop body portion, the drift stop blocking member is slidably disposed in the passage, a drift stop blocking member spring is disposed in the passage, a drift stop blocking member positioning surface is disposed in the passage near one open end region of the passage, the positioning surface is a reduced diameter region of the passage, the drift stop blocking member engages the positioning surface to limit the lateral movement of the drift stop blocking member in a direction toward the drift stop cavity wall when the drift stop blocking member is spaced from the drift stop blocking surface, a drift stop blocking member spring stop is disposed in the passage near another open end region of the passage, and the spring is disposed intermediate the spring stop and the drift stop blocking member.

9. A fluid power cylinder assembly as set forth in claim 8, wherein the drift stop blocking surface includes an annular ridge extending laterally inwardly from the drift stop cavity wall and at least one substantially conical surface.

10. A fluid power cylinder assembly as set forth in claim 1, wherein the drift stop blocking member is generally spherical.

11. A fluid power cylinder assembly as set forth in claim 1, wherein the drift stop body portion extends longitudinally from the piston body portion, and the piston body portion and the drift stop body portion are of integral single piece construction.

12. A fluid power cylinder assembly as set forth in claim 1, wherein the piston body portion and the drift stop body portion are concentrically disposed along a longitudinal axis.

13. A hydraulic fluid power cylinder assembly comprising a cylinder body, a piston, a piston rod and an end cap, all disposed along a longitudinal axis, the cylinder body having a generally cylindrical interior surface defining a longitudinally extending cylinder bore, the piston having a generally cylindrical longitudinally extending piston body portion with a generally cylindrical exterior surface slidably disposed within the cylinder bore, a drift stop body portion extending longitudinally from the piston body portion and being spaced laterally inwardly from the Interior surface of the cylinder body, the end cap having a longitudinally extending drift stop cavity defined by a longitudinally extending drift stop cavity wall, the drift stop cavity wall having an open end opening into the cylinder bore, a drift stop ridge extending laterally inwardly from the drift stop cavity wall and terminating at a drift stop ridge crest, the drift stop body portion extending longitudinally into the drift stop cavity when the piston body portion and the drift stop body portion are in a first and in a second position, the drift stop body portion being longitudinally spaced from the drift stop cavity when the piston body portion and the drift stop body portion are in a third position, the drift stop body portion including a laterally extending passage, a drift stop blocking member slidably disposed in the passage for lateral movement relative to the drift stop cavity wall and relative to the drift stop ridge crest and relative to the cylinder interior surface, a drift stop blocking member spring disposed in the drift stop passage and biasing the drift stop blocking member laterally outwardly, a drift stop blocking member positioning surface in the drift stop passage, the drift stop blocking member having a first position biased by the drift stop spring against and engaging the positioning surface when the drift stop body portion is in Its first position, the drift stop blocking member being spaced laterally inwardly from the drift stop cavity wall when the drift stop body portion is in its first position, the drift stop blocking member having a second position spaced from the positioning surface when the drift stop body portion is in its second position, the drift stop blocking member being biased by the drift stop spring against and engaging the drift stop ridge crest when the drift stop body portion is in its second position, the drift stop blocking member having a third position biased by the drift stop spring against and engaging the positioning surface when the drift stop body portion is in its third position, and the drift stop blocking member being laterally aligned with and spaced from the cylinder interior surface when the drift stop body portion is in its third position.

14. A fluid power cylinder assembly comprising a cylinder body and a piston, the cylinder body having a generally cylindrical interior surface defining a longitudinally extending cylinder chamber, the piston having a generally cylindrical longitudinally extending piston body portion with a generally cylindrical exterior surface slidably disposed within the cylinder interior surface, the piston having a drift stop body portion spaced laterally inwardly from the generally cylindrical exterior surface of the piston, a longitudinally extending drift stop cavity defined by a longitudinally extending drift stop cavity wall, the drift stop cavity having an open end opening into the cylinder chamber, the drift stop cavity being in open fluid pressure communication with the cylinder chamber, the drift stop body portion extending longitudinally into the drift stop cavity when the piston is in a first position within the cylinder chamber, the drift stop body portion being outside the drift stop cavity when the piston is in a second position within the cylinder chamber, the drift stop cavity wall having a drift stop blocking surface extending inward from the drift stop cavity wall, a laterally movable drift stop blocking member carried by the drift stop body portion and biased laterally from the drift stop body portion by a drift stop spring, the drift stop blocking member having a first position engaging the drift stop blocking surface to limit longitudinal movement of the piston when the piston is in its first position, and the drift stop blocking member having a second position spaced from the drift stop blocking surface when a fluid pressure in the fluid pressure in the drift stop cavity overcomes the drift stop spring biasing force to disengage the drift stop blocking member from the drift stop blocking surface allowing the piston to move to its second position.

* * * * *